US005210577A

United States Patent [19]

Nowak

[11] Patent Number: 5,210,577

[45] Date of Patent: May 11, 1993

[54] EDGE EFFECT COMPENSATION IN HIGH FREQUENCY VIBRATORY ENERGY PRODUCING DEVICES FOR ELECTROPHOTOGRAPHIC IMAGING

[75] Inventor: William J. Nowak, Webster, N.Y.

[73] Assignee: Xerox Corporation, Stamford, Conn.

[21] Appl. No.: 887,037

[22] Filed: May 22, 1992

[51] Int. Cl.[5] ..... G03G 15/14

[52] U.S. Cl. ..... 355/273; 355/271

[58] Field of Search ..... 355/274, 276, 271, 273, 355/296; 118/652; 310/325; 15/1.51; 134/1

[56] References Cited

U.S. PATENT DOCUMENTS

| | | | |
|---|---|---|---|
| T893,001 | 12/1971 | Fisler | 134/1 |
| 3,113,225 | 12/1963 | Kleesattel et al. | 310/26 |
| 3,190,793 | 6/1965 | Starke | 162/278 |
| 3,422,479 | 1/1969 | Jeffee | 15/100 |
| 3,483,034 | 12/1969 | Ensminger | 134/1 |
| 3,635,762 | 1/1972 | Ott et al. | 134/1 |
| 3,653,758 | 4/1972 | Trimmer et al. | 355/273 |
| 3,713,987 | 1/1973 | Low | 435/294 |
| 3,733,238 | 5/1973 | Long et al. | 156/580 |
| 3,741,117 | 6/1973 | Bienert et al. | 355/271 X |
| 3,854,974 | 12/1974 | Sato et al. | 430/126 |
| 4,007,982 | 2/1977 | Stange | 355/299 |
| 4,111,546 | 9/1978 | Maret | 355/297 |
| 4,121,947 | 10/1978 | Hemphill | 134/1 |
| 4,187,774 | 2/1980 | Iwasa et al. | 355/271 X |
| 4,363,992 | 12/1982 | Holze, Jr. | 310/323 |
| 4,546,722 | 10/1985 | Toda et al. | 118/657 |
| 4,684,242 | 8/1987 | Schultz | 355/307 |
| 4,794,878 | 1/1989 | Connors et al. | 118/653 |
| 4,833,503 | 5/1989 | Snelling | 355/259 |
| 4,987,456 | 1/1991 | Snelling et al. | 355/273 |
| 5,005,054 | 4/1991 | Stokes et al. | 355/273 |
| 5,010,369 | 4/1991 | Nowak et al. | 355/273 |
| 5,016,055 | 5/1991 | Pietrowski et al. | 355/273 |
| 5,025,291 | 6/1991 | Nowak et al. | 355/273 |
| 5,030,999 | 7/1991 | Lindblad et al. | 355/297 |
| 5,081,500 | 1/1992 | Snelling | 355/273 |

FOREIGN PATENT DOCUMENTS

| | | | |
|---|---|---|---|
| 2280115 | 8/1976 | France . | |
| 0037042 | 3/1977 | Japan | 355/273 |
| 62-195685 | 2/1986 | Japan . | |

OTHER PUBLICATIONS

Xerox Disclosure Journal; "Floating Diaphragm Vacuum Shoe"; Hull et al.; vol. 2, No. 6, Nov./Dec. 1977; pp. 117-118.

*Primary Examiner*—A. T. Grimley
*Assistant Examiner*—William J. Royer
*Attorney, Agent, or Firm*—Mark Costello

[57] ABSTRACT

An imaging device includes a non-rigid member with a charge retentive surface moving along an endless path, an arrangement for creating a latent image on the charge retentive surface, a developer to develop the latent image with toner, a transfer arrangement electrostatically transferring the developed toner image to a copy sheet, and a resonator for enhancing toner release from the charge retentive surface, producing relatively high frequency vibratory energy and having a portion adapted for contact across the non-rigid member, generally transverse to the direction of movement of the non-rigid member. The resonator includes an energy transmitting horn having a platform portion and a horn portion including a set of linearly arranged horn elements, each horn element having a contacting portion for contacting the non-rigid member; a voltage source producing a voltage signal; a plurality of vibratory energy producing devices, each corresponding to a horn element to drive the horn elements to vibrate, each vibratory energy producing device producing a vibration responsive to an applied voltage signal directed to each from the voltage source. The plurality of vibratory energy producing devices includes at least two groups, each group having a vibration response to the applied voltage signal directed thereto distinct from the other, to provide a substantially uniform vibration response to the applied voltage signal across the resonator.

9 Claims, 5 Drawing Sheets

EDGE EFFECT COMPENSATION IN HIGH FREQUENCY VIBRATORY ENERGY PRODUCING DEVICES FOR ELECTROPHOTOGRAPHIC IMAGING

This invention relates to reproduction apparatus, and more particularly, to an apparatus for uniformly applying high frequency vibratory energy to an imaging surface for electrophotographic applications.

INCORPORATION BY REFERENCE

The following United States patents are specifically incorporated by reference for their background teachings, and specific teachings of the principles of operation, construction and use of resonators for applying toner releasing vibrations to the charge retentive surfaces of electrophotographic devices: U.S. Pat. Nos. 5,030,999 to Lindblad et al.; 5,005,054, to Stokes et al.; 4,987,456 to Snelling et al.; 5,010,369 to Nowak et al.; 5,025,291 to Nowak et al.; 5,016,055 to Pietrowski et al.; 5,081,500 to Snelling; and U.S. patent application Ser. No. 07/620,520, "Energy Transmitting Horn Bonded to an Ultrasonic Transducer for Improved Uniformity at the Horn Tip", by R. Stokes et al.

BACKGROUND OF THE INVENTION

In electrophotographic applications such as xerography, a charge retentive surface is electrostatically charged and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder or powder suspension referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. The process is well known and useful for light lens copying from an original and printing applications from electronically generated or stored originals, where a charged surface may be imagewise discharged in a variety of ways. Ion projection devices where a charge is imagewise deposited on a charge retentive substrate operate similarly. In a slightly different arrangement, toner may be transferred to an intermediate surface, prior to retransfer to a final substrate.

Transfer of toner from the charge retentive surface to the final substrate is commonly accomplished electrostatically. A developed toner image is held on the charge retentive surface with electrostatic and mechanical forces. A substrate (such as a copy sheet) is brought into intimate contact with the surface, sandwiching the toner thereinbetween. An electrostatic transfer charging device, such as a corotron, applies a charge to the back side of the sheet, to attract the toner image to the sheet.

Unfortunately, the interface between the sheet and the charge retentive surface is not always optimal. Particularly with non-flat sheets, such as sheets that have already passed through a fixing operation such as heat and/or pressure fusing, or perforated sheets, or sheets that are brought into imperfect contact with the charge retentive surface, the contact between the sheet and the charge retentive surface may be nonuniform, characterized by gaps where contact has failed. There is a tendency for toner not to transfer across these gaps. A copy quality defect referred to as transfer deletion results.

That acoustic agitation or vibration of a surface can enhance toner release therefrom is known, as described by U.S. Pat. Nos. 4,111,546 to Maret, 4,684,242 to Schultz, 4,007,982 to Stange, 4,121,947 to Hemphill, Xerox Disclosure Journal "Floating Diaphragm Vacuum Shoe", by Hull et al., Vol. 2, No. 6, November/-December 1977, U.S. Pat. Nos. 3,653,758 to Trimmer et al., 4,546,722 to Toda et al., 4,794,878 to Connors et al., 4,833,503 to Snelling, Japanese Published Patent Appl. 62-195685, U.S. Pat. No. 3,854,974 to Sato et al., and French patent No. 2,280,115.

Resonators for applying vibrational energy to some other member are known, for example in U.S. Pat. Nos. 4,363,992 to Holze, Jr., 3,113,225 to Kleesattel et al., 3,733,238 to Long et al., and 3,713,987 to Low.

Coupling of vibrational energy to a surface has been considered in Defensive Publication T893,001 by Fisler. U.S. Pat. Nos. 3,635,762 to Ott et al., 3,422,479 to Jeffee, 4,483,034 to Ensminger and 3,190,793 Starke.

In the ultrasonic welding horn art, as exemplified by U.S. Pat. No. 4,363,992 to Holze, Jr., where blade-type welding horns are used for applying high frequency energy to surfaces, it is known that the provision of slots through the horn perpendicular to the direction in which the welding horn extends, reduces undesirable mechanical coupling of effects across the contacting horn surface.

It has been noted that even with fully segmented horns, as shown in U.S. Pat. No. 5,025,291 to Nowak et al., there is a fall-off in response of the resonator at the outer edges of the device. A similar fall off is shown in U.S. Pat. No. 4,363,992 to Holze, Jr., at FIG. 2, showing the response of the resonator of FIG. 1.

All the references cited herein are specifically incorporated by reference for their teachings.

SUMMARY OF THE INVENTION

In accordance with the invention there is provided a resonator for uniformly applying vibratory energy to a non-rigid image bearing member of an electrophotographic device to cause mechanical release of a toner image from the charge retentive surface for enhanced subsequent toner removal, where the resonator includes a plurality of drivable vibratory elements in a unitary structure, each element have a predetermined vibratory response to a common driving voltage, in accordance with a scheme to achieve optimum uniformity.

In accordance with one aspect of the invention, an electrophotographic device of the type contemplated by the present invention includes a non-rigid member having a charge retentive surface, driven along an endless path through a series of processing stations that create a latent image on the charge retentive surface, develop the image with toner, and bring a sheet of paper or other transfer member into intimate contact with the charge retentive surface at a transfer station for electrostatic transfer of toner from the charge retentive surface to the sheet. Subsequent to transfer, the charge retentive surface is cleaned of residual toner and debris. For the enhancement of toner release from a surface at any of the processing stations, a resonator suitable for generating vibratory energy is arranged in line contact with the back side of the non-rigid member, to uniformly apply vibratory energy thereto. The resonator comprises a support member, a horn divided into a plurality of segments, the horn provided with a unitary platform portion, and having horn and contacting portions forming each horn segment, and a like plurality of vibration producing elements that drive the horn at a resonant frequency to apply vibratory energy to the member. Each vibration producing element is a piezoelectric element having a voltage response selected to provide a uniform output with respect to the other elements across the edge of the resonator, formed by the plurality of segments. The selection of the voltage response can be obtained by a process referred to as partial poling of the full piezoelectric electromechanical property. The invention has equal application to a cleaning station, where mechanical release of toner prior to or in conjunction with mechanical, electrostatic or electromechanical cleaning will improve the release of residual toner remaining after transfer.

In accordance with another aspect of the invention, to compensate for the effects of energy coupling across the resonator that result in a roll off in response at the outer horn segments, the vibration producing elements corresponding to the outer horn segments are piezoelectric elements having a voltage response selected to provide a uniform output, with respect to the piezoelectric elements corresponding to the inner horn segments.

U.S. Pat. No. 5,030,999 to Lindblad et al. assigned to the same assignee as the present invention, and specifically incorporated herein by reference suggests, preclean treatment enhancement by application of vibratory energy. The present invention finds use in this application as well.

These and other aspects of the invention will become apparent from the following description used to illustrate a preferred embodiment of the invention read in conjunction with the accompanying drawings in which.

Reproduction machines of the type contemplated for use with the present invention are well known and need not be described herein. U.S. Pat. Nos. 5,030,999 to Lindblad et al.; 5,005,054, to Stokes et al.; 4,987,456 to Snelling et al.; 5,010,369 to Nowak et al.; 5,025,291 to Nowak et al.; 5,016,055 to Pietrowski et al.; 5,081,500 to Snelling; and U.S. patent application Ser. No. 07/620,520, "Energy Transmitting Horn Bonded to an Ultrasonic Transducer for Improved Uniformity at the Horn Tip", by R. Stokes et al., adequately describe such devices, and the application of transfer improving vibration inducing devices, and are specifically incorporated herein by reference.

Figure 1:
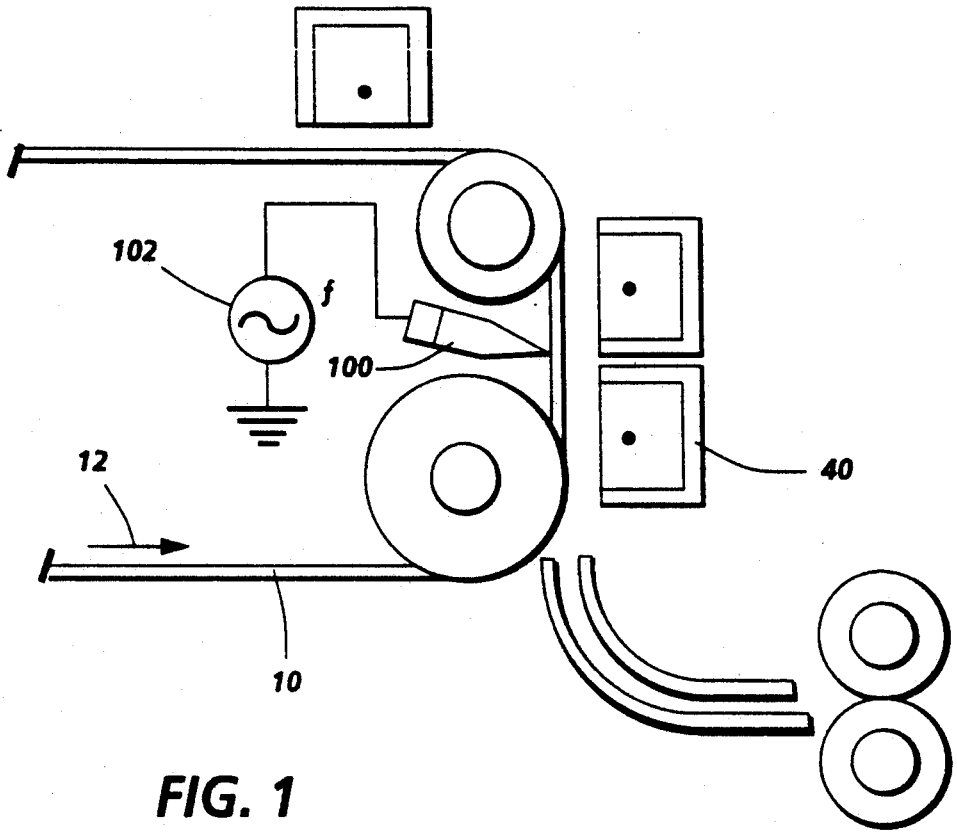
FIG. 1 is a schematic illustration of the transfer station and the associated ultrasonic transfer enhancement device of the invention.

With reference to FIG. 1, wherein a portion of a reproduction machine is shown including at least portions of the transfer, detack and precleaning functions thereof, the basic principle of enhanced toner release is illustrated, where a relatively high frequency acoustic or ultrasonic resonator 100 driven by an A.C. source 102 operated at a frequency f between 20 kHz and 200 kHz, is arranged in vibrating relationship with the interior or back side of an image receiving belt 10, at a position closely adjacent to where the belt passes through a transfer station. Vibration of belt 10 agitates toner developed in imagewise configuration onto belt 10 for mechanical release therefore from belt 10, allowing the toner to be electrostatically attracted to a sheet during the transfer step, despite gaps caused by imperfect paper contact with belt 10. Additionally, increased transfer efficiency with lower transfer fields than normally used appears possible with the arrangement. Lower transfer fields are desirable because the occurrence of air breakdown (another cause of image quality defects) is reduced. Increased toner transfer efficiency is also expected in areas where contact between the sheet and belt 10 is optimal, resulting in improved toner use efficiency, and a lower load on the cleaning system. In a preferred arrangement, the resonator 100 is arranged with a vibrating surface parallel to belt 10 and transverse to the direction of belt movement 12, generally with a length approximately coextensive with the belt width. The belt described herein has the characteristic of being non-rigid, or somewhat flexible, to the extent that it it can be made to follow the resonator vibrating motion.

Figure 2A:
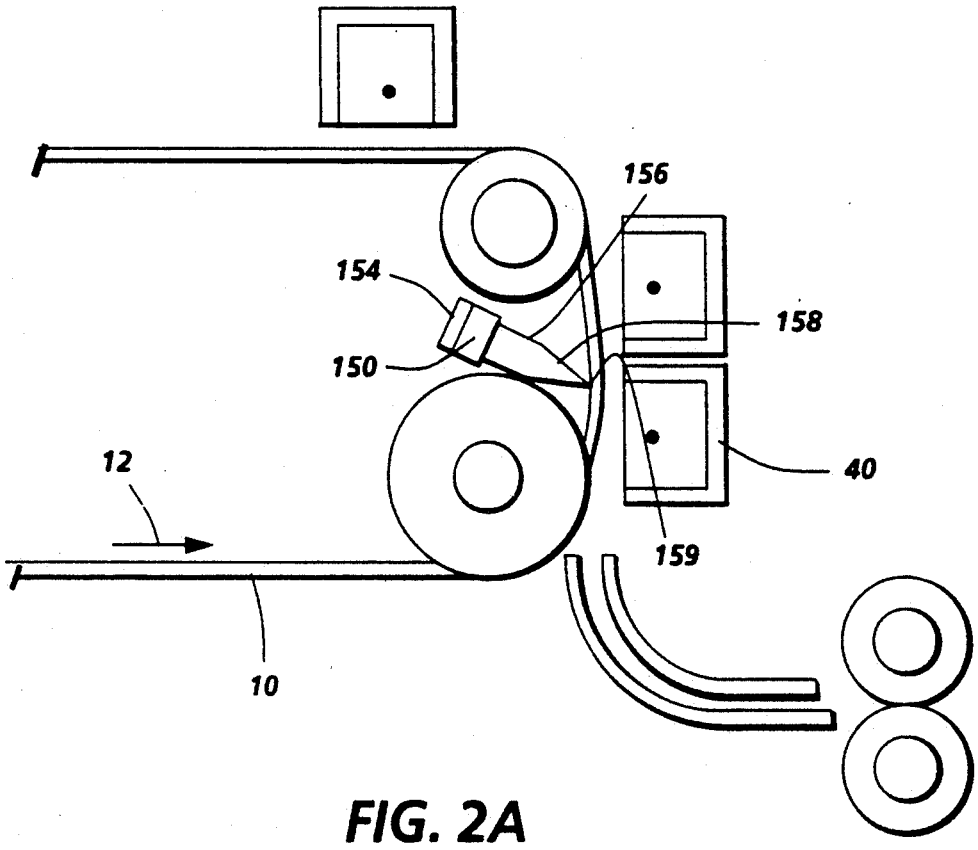
FIGS. 2A and 2B illustrate schematically two arrangements to couple an ultrasonic resonator to an imaging surface.
Figure 2B:
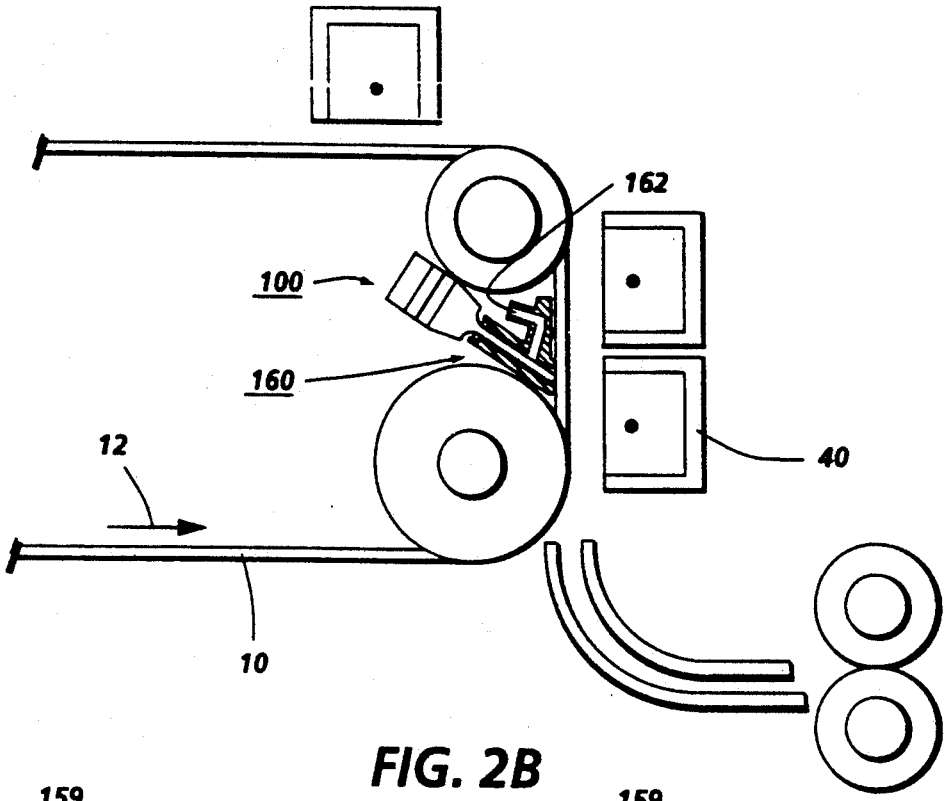
Figure 3:
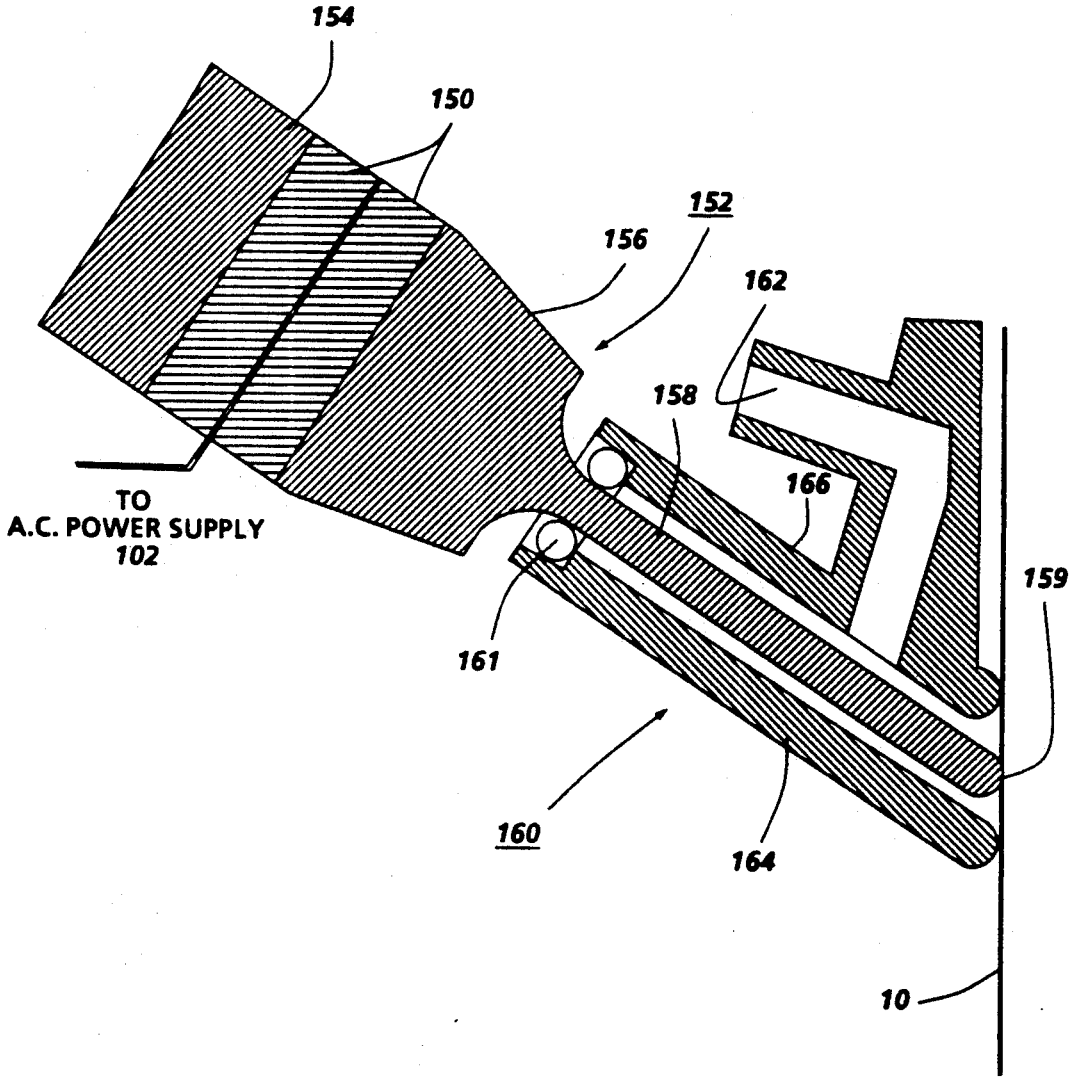
FIG. 3 is a cross sectional views of a vacuum coupling assembly in accordance with the invention.

With reference to FIGS. 2A and 2B, and better shown in FIG. 3, the vibratory energy of the resonator 100 may be coupled to belt 10 in a number of ways. In the arrangements shown, resonator 100 may comprise a piezoelectric transducer element 150 and horn 152, together supported on a backplate 154. Horn 152 includes a platform portion 156 and a horn tip 158 and a contacting tip 159 in contact with belt 10 to impart the acoustic energy of the resonator thereto. To hold horn 152 and the piezoelectric transducer element 150, an adhesive such as an epoxy and conductive mesh layer may be used to bond the horn and piezoelectric transducer element together. In a working example, the mesh was a nickel coated monofilament polyester fiber (from Tetko, Inc.) with a mesh thickness on the order of 0.003" thick encapsulated in a thermosetting epoxy having a thickness of 0.005"(before compression and heating). Other meshes, including metallic meshes of phosphor bronze and Monel may be satisfactory. Two part cold setting epoxies may also be used, as may other adhesives. Alternatively, a bolt and nut arrangement may be used to clamp the assembly together.

In the fabrication of the arrangement, the epoxy and conductive mesh layer are sandwiched between the horn and piezoelectric material, and clamped to ensure good flow of the epoxy through the mesh and to all surfaces. It appears to be important that the maximum temperature exposure of the PZT be about 50% of its curie point. Epoxies are available with curing temperatures of 140°, and piezoelectric materials are available from 195° to 350°. Accordingly, an epoxy-PZT pair is preferably selected to fit within this limitation.

The contacting tip 159 of horn 152 may be brought into a tension or penetration contact with belt 10, so that movement of the tip carries belt 10 in vibrating motion. Penetration can be measured by the distance that the horn tip protrudes beyond the normal position of the belt, and may be in the range of 1.5 to 3.0 mm. It should be noted that increased penetration produces a ramp angle at the point of penetration. For particularly stiff sheets, such an angle may tend to cause lift at the trail edges thereof.

As shown in FIG. 2B, to provide a coupling arrangement for transmitting vibratory energy from a resonator 100 to photoreceptor 10, the resonator may be arranged in association with a vacuum box arrangement 160 and vacuum supply 162 (vacuum source not shown) to provide engagement of resonator 100 to photoreceptor 10 without penetrating the normal plane of the photoreceptor.

FIG. 3 shows an assembly arranged for coupling contact with the backside of imaging receiving surface 10, which presents considerable spacing concerns. Accordingly, horn tip 158 extends through a generally air tight vacuum box 160, which is coupled to a vacuum source such as a diaphragm pump or blower (not shown) via outlet 162 formed in one or more locations along the length of upstream or downstream walls 164 and 166, respectively, of vacuum box 160. Walls 164 and 166 are approximately parallel to horn tip 159, extending to approximately a common plane with the contacting tip 159, and forming together an opening in vacuum box 160 adjacent to the photoreceptor belt 10, at which the contacting tip contacts the photoreceptor. The vacuum box is sealed at either end (inboard and outboard sides of the machine) thereof (not shown). The entry of horn tip 158 into vacuum box 160 is sealed with an elastomer sealing member 161, which also serves to isolate the vibration of horn tip 158 from wall 164 and 166 of vacuum box 160. When vacuum is applied to vacuum box 160, via outlet 162, belt 10 is drawn into contact with walls 164 and 166 and horn tip 158, so that horn tip 158 imparts the acoustic energy of the resonator to belt 10. Interestingly, walls 164 or 166 of vacuum box 160 also tend to damp vibration of the belt outside the area in which vibration is desired, so that the vibration does not disturb the dynamics of the sheet tacking or detacking process, or the integrity of the developed image.

With reference to FIGS. 2B and 3, application of high frequency acoustic or ultrasonic energy to belt 10 occurs within the area of application of transfer field, and preferably within the area under transfer corotron 40. While transfer efficiency improvement appears to be obtained with the application of high frequency acoustic or ultrasonic energy throughout the transfer field, in determining an optimum location for the positioning of resonator 100, it has been noted that transfer efficiency improvement is at least partially a function of the velocity of the horn tip 158. As tip velocity increases, it appears that a desirable position of the resonator is approximately opposite the centerline of the transfer corotron. For this location, optimum transfer efficiency was achieved for tip velocities in the range of 300–500 mm/sec. At very low tip velocity, from 0 mm/second to 45 mm/sec, the positioning of the transducer has relatively little effect on transfer characteristics. Restriction of application of vibrational energy, so that the vibration does not occur outside the transfer field is preferred. Application of vibrational energy outside the transfer field tends to cause greater electromechanical adherence of toner to the surface creating a problem for subsequent transfer or cleaning.

Figure 4A:
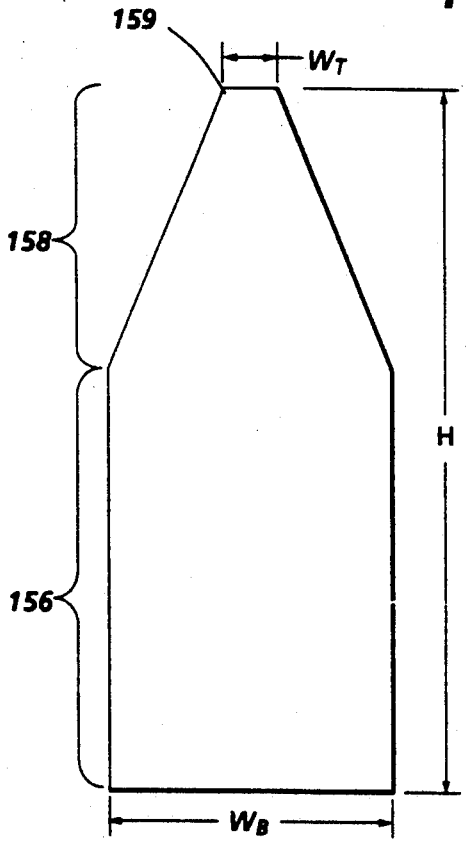
FIGS. 4A and 4B are cross sectional views of two types of horns suitable for use with the invention.
Figure 4B:
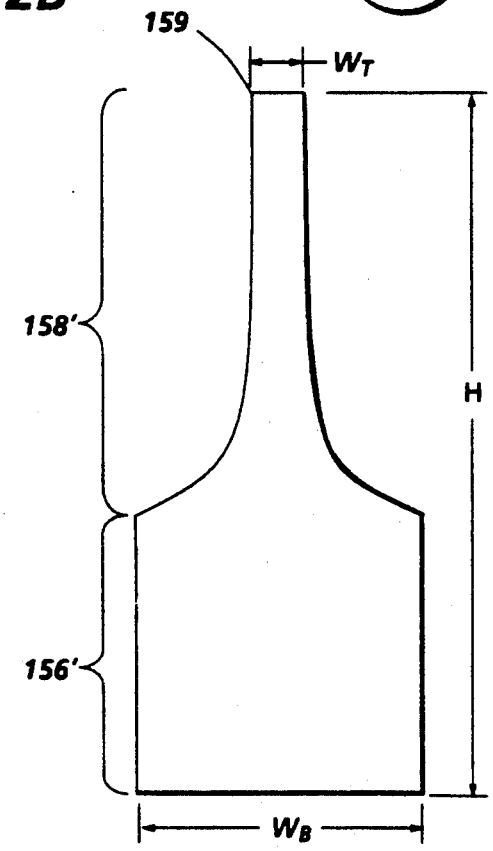

At least two shapes for the horn have been considered. With reference to FIG. 4A, in cross section, the horn may have a trapezoidal shape, with a generally rectangular base 156 and a generally triangular tip portion 158, with the base of the triangular tip portion having approximately the same size as the base. Alternatively, as shown in FIG. 4B, in cross section, the horn may have what is referred to as a stepped shape, with a generally rectangular base portion 156', and a stepped horn tip 158'. The trapezoidal horn appears to deliver a higher natural frequency of excitation, while the stepped horn produces a higher amplitude of vibration. The height H of the horn appears to have an effect on the frequency and amplitude response, with a shorter tip to base length delivering higher frequency and a marginally greater amplitude of vibration. Desirably the height H of the horn will fall in the range of approximately 1 to 1.5 inches (2.54 to 3.81 cm), with greater or lesser lengths not excluded. The ratio of the base width $W_B$ to tip width $W_T$ also effects the amplitude and frequency of the response with a higher ratio producing a higher frequency and a marginally greater amplitude of vibration. The ratio of $W_B$ to $W_T$ is desirably in the range of about 3:1 to about 6.5:1. The length L of the horn across belt 10 also effects the uniformity of vibration, with the longer horn producing a less uniform response. A desirable material for the horn is aluminum. Satisfactory piezoelectric materials, including lead zirconate-lead titanate composites sold under the trademark PZT by Vernitron, Inc. (Bedford, Ohio), have high $D_{33}$ values. Suitable materials may also be available from Motorola Corporation, Albuquerque, N.M. Displacement constants are typically in the range of 400–500 $^{m}/_{v} \times 10^{-12}$. There may be other sources of vibrational energy, which clearly support the present invention, including but not limited to magnetostriction and electrodynamic systems.

In considering the structure of the horn 152 across its length L, several concerns must be addressed. It is highly desirable for the horn to produce a uniform response along its length, or non-uniform transfer characteristics may result. It is also highly desirable to have a unitary structure, for manufacturing and application requirements.

A.C. power supply 102 drives piezoelectric transducer 150 at a frequency f selected based on the natural excitation frequency of the horn 160. Horn tip velocity is desirably maximized for optimum toner release, but as the excitation frequency varies from the natural excitation frequency of the device, the tip velocity response drops off sharply. Accordingly, it may be desirable for frequency f to be set through a range of frequency to obtain optimum energy transfer to the belt through the horn. The desired period of the frequency sweep, i.e., sweeps/sec. is based on photoreceptor speed, and selected so that each point along the photoreceptor sees the maximum tip velocity, and experiences a vibration large enough to assist toner transfer. At least three methods of frequency band excitation are available: a frequency band limited random excitation that will continuously excite in a random fashion all the frequencies within the frequency band; a simultaneous excitation of all the discrete resonances of the individual horns with a given band; and a swept sine excitation method where a single sine wave excitation is swept over a fixed frequency band. Of course, many other wave forms besides sinusoidal may be applied. By these methods, a single, or identical dilation mode is obtained for all the horns.

It has been previously noted that there is a tendency for the response of the segmented horn segment to fall off at the edges of the horn, as a result of the continuous mechanical behavior of the device. However, uniform response along the entire device, arranged across the width of the imaging surface, is required. To compensate for the edge roll off effect, the piezoelectric transducer elements of the resonator may be segmented into a series of devices, each associated with at least one of the horn segments, with a separate driving signal to at least the edge elements. In accordance with the invention and with reference to FIGS. 5A and 5B, the resonator with the piezoelectric transducer elements of the resonator segmented into a series of devices, each associated with at least one of the horn segments, with a single driving signal at frequency f to each of the elements. A plurality of vibratory energy producing means or piezoelectric elements 154, each corresponding to at least one horn element 152 drive horn elements to vibrate, each vibratory energy producing means producing a vibration responsive to an applied voltage signal directed to each from the voltage source 102. However, the piezoelectric elements are differentially poled. The plurality of vibratory energy producing means include at least two groups thereof, each group having a vibration response to the applied voltage signal directed thereto distinct from the other, to provide a substantially uniform vibration response to the applied voltage signal across the resonator. The horn portion can be considered to include a set of horn elements arranged across the imaging surface, the set of horn elements including a first end subset (in an example, piezoelectric elements corresponding to horn elements 1, 2, 3), a second end subset (in the example, piezoelectric elements corresponding to horn elements 17, 18 and 19) and a central subset (in the example, the remainder of the piezoelectric elements). In one example, the numbered 1, 2, 3, 17, 18 and 19 are fully poled, while the remainder are only partially poled (in the example, half-poled). Accordingly, the response, in terms of in/sec/volt at the partially poled piezoelectric elements is reduced. The reduced response also appears to have an overall effect on the device. Partially poling refers to control of the d value of the piezoelectric material, or for ferroelectric ceramic materials, the d33 value. The d33 value, the piezoelectric constant, given in terms of $10^{-11}$ coulomb/newton, is a measurement of the degree to which the materials are charge polarized. the d33 value is controlable at the charge polarization step. Alternatively, while the previous discussion suggests the same material set having altered properties, there is no reason in principle that different piezoelectric materials having different response characteristics could not be used.

Figure 5A:
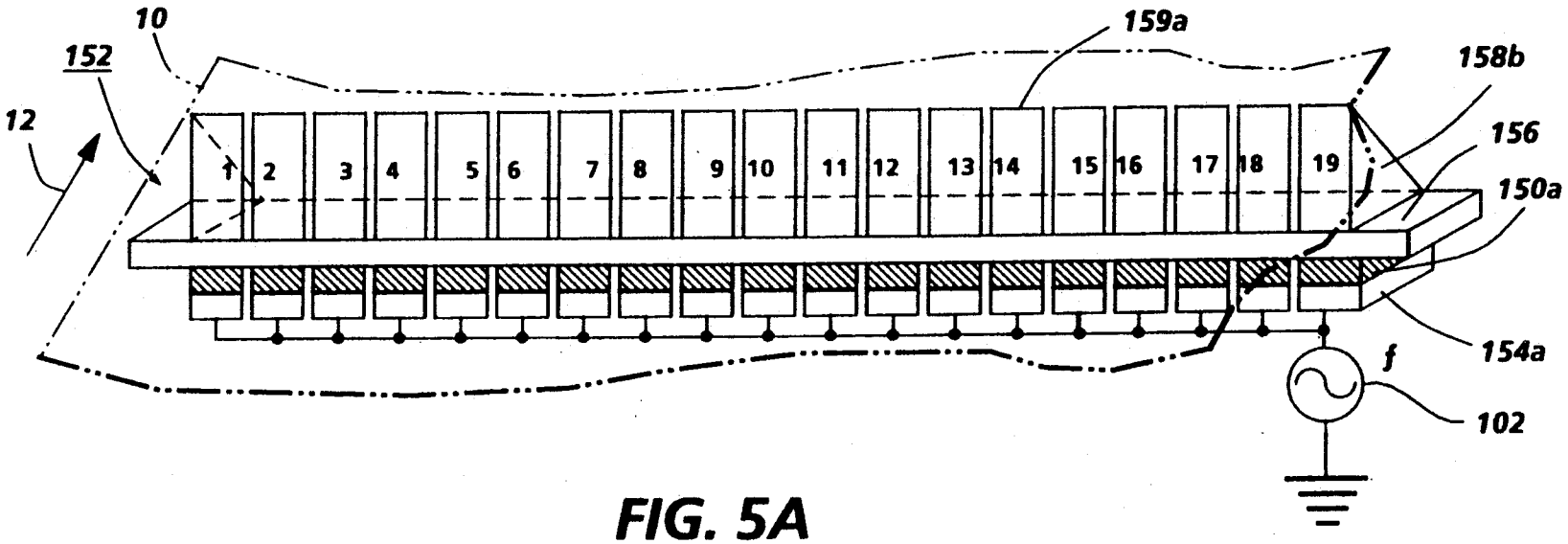
FIGS. 5A and 5B are, respectively, a view of a resonator and a graph of the response across the tip at a selected frequency.
Figure 5B:
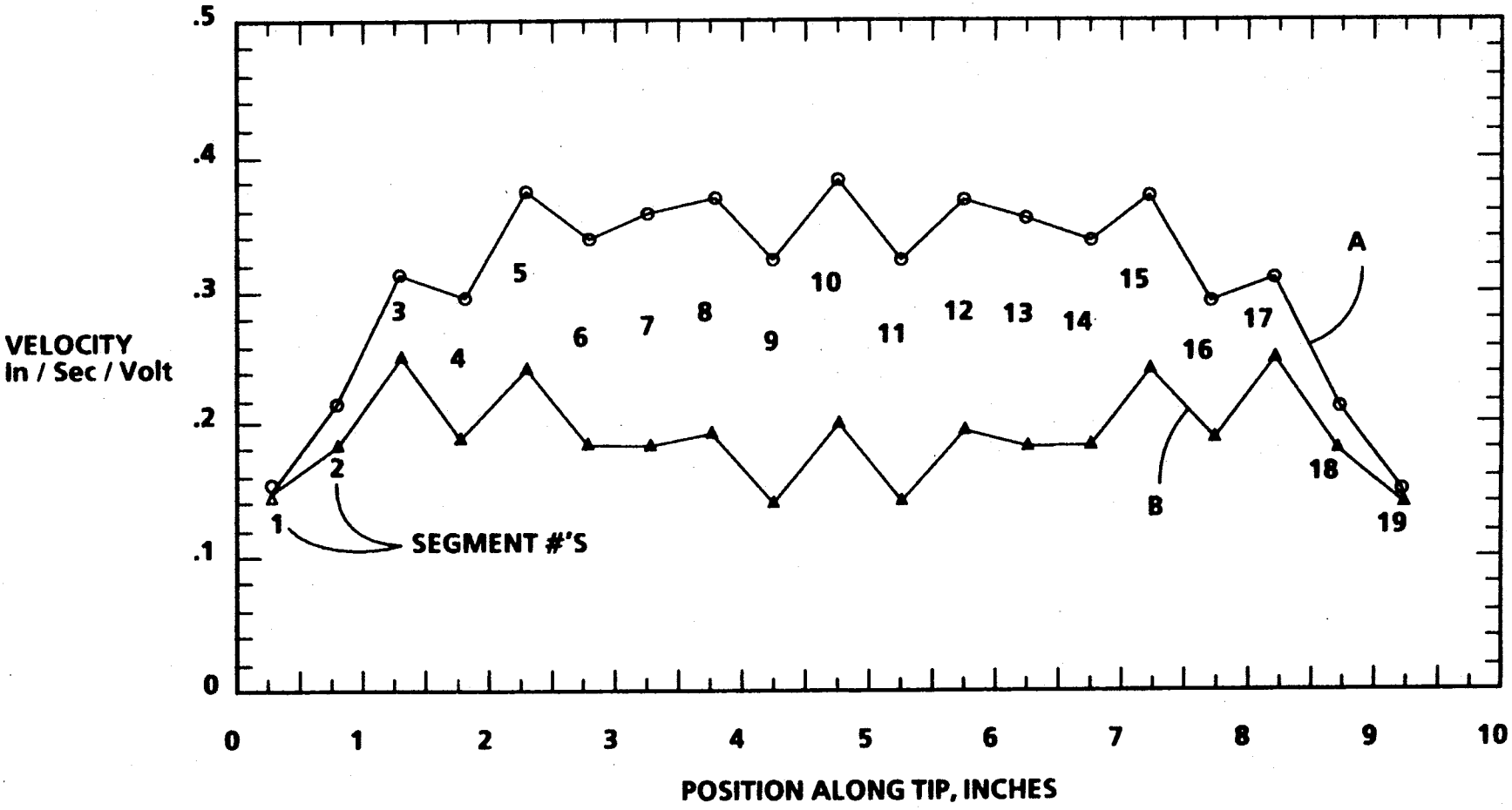

A comparison of a device in which all the piezoelectric elements are fully poled, and a device in which some of the piezoelectric elements are half poled is shown in FIG. 5B. Given a device as shown in FIG. 5A, driven at a single frequency 60.7 KHz, with each piezoelectric elements fully poled, the device response is given by curve A in a plot of peak velocity response (given in in/sec/volt) v. position along the device, which shows variations in response from approximately 0.15 in/sec/volt at the edges of the device (corresponding to a first group piezoelectric elements 1 and 19), to approximately 0.38 in/sec/volt in a central portion of the device (corresponding to a second group piezoelectric elements 5, 10 and 15). Curve B shows the response flattened and more uniform, varying from approximately 0.15 in/sec/volt at the edges of the device (corresponding to piezoelectric elements 1 and 19), to approximately 0.25 in/sec/volt (maximum) in a central portion of the device (corresponding to piezoelectric elements 3, 17). A reduced average velocity is noted but could be increased to nominal by increasing the applied voltage slightly.

It will no doubt be appreciated that the inventive resonator and vacuum coupling arrangement has equal application in the cleaning station of an electrophotographic device with little variation in structure.

As a means for improving uniformity of application of vibratory energy to a flexible member for the release of toner therefrom, the described resonator may find numerous uses in electrophotographic applications. One example of a use may be in causing release of toner from a toner bearing donor belt, arranged in development position with respect to a latent image. Enhanced development may be noted, with mechanical release of toner from the donor belt surface and electrostatic attraction of the toner to the image.

The invention has been described with reference to a preferred embodiment. Obviously modifications will occur to others upon reading and understanding the specification taken together with the drawings. This embodiment is but one example, and various alternatives, modifications, variations or improvements may be made by those skilled in the art from this teaching which are intended to be encompassed by the following claims.

I claim:

1. In an imaging device having a non-rigid member with a charge retentive surface moving along an endless path, means for creating a latent image on the charge retentive surface, means for imagewise developing the latent image with toner, means for electrostatically transferring the developed toner image to a copy sheet, and a resonator for enhancing toner release from the charge retentive surface, producing relatively high frequency vibratory energy and having a portion thereof adapted for contact across the non-rigid member, generally transverse to the direction of movement thereof, the resonator comprising:

an energy transmitting horn member, for applying high frequency vibratory energy to the non-rigid member, having a platform portion, a horn portion including a set of linearly arranged horn elements, each horn element having a contacting portion for contacting the non-rigid member;

a voltage source producing a voltage signal;

a plurality of vibratory energy producing means, each corresponding to a horn element to drive said horn elements to vibrate, each vibratory energy producing means producing a vibration responsive to an applied voltage signal directed to each from said voltage source;

said plurality of vibratory energy producing means including at least two groups thereof, each group having a vibration response to said applied voltage signal directed thereto distinct from the other, to provide a substantially uniform vibration response to the applied voltage signal across the resonator.

2. The device as defined in claim 1, wherein said vibratory energy producing means is a piezoelectric element.

3. The device as defined in claim 2, wherein each group of piezoelectric elements have similar poling characteristics within the group, while between each group, the piezoelectric elements have different poling characteristics.

4. The device as defined in claim 2, wherein said each group of piezoelectric elements have similar voltage signal response characteristics within the group, while between each group, the piezoelectric elements have different voltage response characteristics.

5. In an imaging device having a non-rigid member with a charge retentive surface moving along an endless path, means for creating a latent image on the charge retentive surface, means for imagewise developing the latent image with toner, means for electrostatically transferring the developed toner image to a copy sheet, and a resonator for enhancing toner release from the charge retentive surface, producing relatively high frequency vibratory energy and having a portion thereof adapted for contact across the non-rigid member, generally transverse to the direction of movement thereof, the resonator comprising:

an energy transmitting horn member, for applying high frequency vibratory energy to the non-rigid member, having a platform portion, a horn portion including a set of horn elements linearly arranged to extend across the non-rigid member, each horn element having a contacting portion for contacting the non-rigid member and responsive to a driving vibration, the set of horn elements including a first end subset at one end of the linear arranged horn elements, a second end subset at a distal end of the linear arranged horn elements, and a central subset including the remainder of the linearly arranged horn elements;

a voltage source producing a voltage signal;

a plurality of vibratory energy producing means to drive said horn member to vibrate, each vibratory energy producing means producing a vibration responsive to the voltage signal directed from said voltage source, to drive a corresponding horn element to resonance;

each vibratory energy producing means corresponding to a horn element in the first end and second end subsets having a vibration response to said voltage signal directed thereto distinct from each vibratory energy producing means corresponding to a horn element in the central subset, to provide a substantially uniform vibration response to the applied voltage signal across the resonator.

6. The device as defined in claim 5, wherein said vibratory energy producing means is a piezoelectric element.

7. The device as defined in claim 6, wherein said piezoelectric elements corresponding to horn elements in the first end and second end subsets have similar poling characteristics, while the piezoelectric elements of the central subset have different poling characteristics than the piezoelectric elements of the first end and second end subsets.

8. The device as defined in claim 6, wherein said each subset of piezoelectric elements have similar voltage signal response characteristics within the subset, while between each subset, the piezoelectric elements have different voltage response characteristics.

9. A resonator adapted to vibrate a moving non-rigid member comprising:

an energy transmitting horn member, for applying high frequency vibratory energy to a moving surface, having a platform portion, a horn portion including a set of horn elements linearly arranged across a length thereof, each horn element having a contacting portion for contacting a surface and responsive to a driving vibration, the set of horn elements including a first end subset, a second end subset and a central subset;

a voltage source producing a voltage signal;

a plurality of vibratory energy producing means to drive said horn member to vibrate, each vibratory energy producing a vibration responsive to the voltage signal directed to each from said voltage source, to drive a corresponding horn element to resonance;

each vibratory energy producing means corresponding to a horn element in the first end and second end subsets having a vibration response to said voltage signal directed thereto distinct from each vibratory energy producing means corresponding to a horn element in the central subset, to provide a substantially uniform vibration response to the applied voltage

* * * * *